US006286343B1

(12) United States Patent
Sangiacomo

(10) Patent No.: US 6,286,343 B1
(45) Date of Patent: Sep. 11, 2001

(54) DEVICE FOR SELECTING THE SINKERS FOR THE MANUFACTURE OF DESIGNED TERRY CLOTH KNITWEAR ON CIRCULAR KNITTING MACHINES AND STOCKING KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/790,091

(22) Filed: Feb. 21, 2001

(30) Foreign Application Priority Data

May 10, 2000 (IT) ..... BS2A00044

(51) Int. Cl.[7] ..... D04B 15/06
(52) U.S. Cl. ..... 66/217; 66/107
(58) Field of Search ..... 66/217, 216, 222, 66/224, 225, 104, 106, 107

(56) References Cited

U.S. PATENT DOCUMENTS 4,314,461 * 2/1982 Conti ..... 66/217
4,519,221 * 5/1985 Hirano ..... 66/107
6,089,047 * 7/2000 Wang ..... 66/91
6,105,402 * 8/2000 Lee ..... 66/217

* cited by examiner

*Primary Examiner*—Danny Worrell
(74) *Attorney, Agent, or Firm*—McGlew and Tuttle, P.C.

(57) ABSTRACT

A device for the selection of the sinkers for the manufacture of designed terry cloth knitwear on circular knitting machines and stocking knitting machines. Each sinker (13) is capable of oscillations in a vertical plane between a canceled, resting position, in which its tail end (21) is not intercepted by a return cam (24), and an operating position, in which its tail end interacts with the return cam for the longitudinal movements of the sinker. The sinker also has a bottom part that interacts with inlet and outlet cams, and the sinker can be moved from the canceled, resting position to the operating position by a selection device acting on an oscillating selector associated with the shaft of the sinker.

4 Claims, 2 Drawing Sheets

DEVICE FOR SELECTING THE SINKERS FOR THE MANUFACTURE OF DESIGNED TERRY CLOTH KNITWEAR ON CIRCULAR KNITTING MACHINES AND STOCKING KNITTING MACHINES

FIELD OF THE INVENTION

The present invention pertains to the manufacture of terry cloth knitwear on circular knitting machines and stocking knitting machines and more specifically to the manufacture of designed terry cloth knitwear.

BACKGROUND OF THE INVENTION

Among the various methods for the manufacture of terry cloth knitwear on circular knitting machines and stocking knitting machines, one is known that uses, in combination, the needles on the cylinder and terry cloth sinkers on a sinker ring, which lies above the cylinder and rotates with same.

The terry cloth knitwear is usually manufactured by starting from at least two yarns fed in in such a way that a first yarn leads to the formation of a basic stitch, while the other yarn is used to form the oblong terry cloth loops on the terry cloth sinkers, configured as needed.

On such machines, it is currently possible to manufacture designed or "sculpted" terry cloth knitwear by means of a selection of the sinkers, which is made based on an operating program with the selection means, acting on selection bottom parts that are integral with the sinkers, but with remarkable performance and selection limits.

SUMMARY AND OBJECTS OF THE INVENTION

The primary object of the present invention is to provide a novel, original device for the selection of the terry cloth sinkers on circular knitting machines, a device which makes possible a selection of sinker by sinker with optimal results and without limitations in the programming of the manufacture of more and more elaborate and valued knitted manufactured articles.

The object is accomplished, according to the present invention, with the use of horizontal sinkers which are capable of oscillations in a vertical plane and where with each sinker is associated a selector element which is provided with selection teeth interacting with a lever selection unit and which oscillates between an inactive position, in which it has no effect on the respective sinker, and an active position, in which it forces the respective sinker to pass from a resting position to an operating position The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 3:
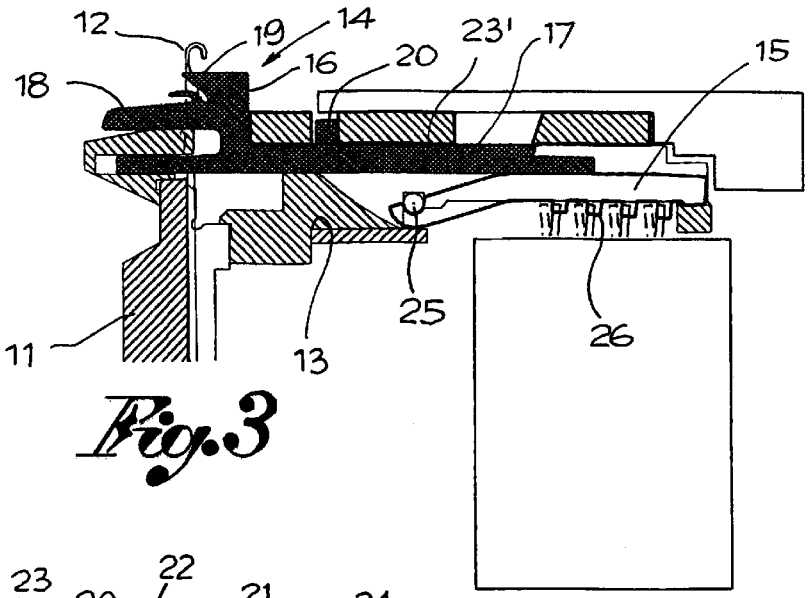
FIG. 3 is a radial sectional view of parts of the cylinder and of the ring, sinker carriers of a circular knitting machine, with a sinker in an unselected position.

Referring to the drawings in particular, the cylinder 11 with vertical needles 12 and the ring 13 with said horizontal sinkers 14 of a circular terry cloth knitting machine are partially shown.

The ring 13 is arranged at the top of the cylinder 11, around same, and it has horizontal grooves, oriented radially to the cylinder on the outside of same, alternated with the needles 12 on the cylinder. In each of its radial grooves, the ring 13 carriers a terry cloth sinker 14 and a selector element 15. In the example illustrated here, the sinker 14 and the selector element 15 are separated, though intended to interact.

The sinker 14 has a head 16 turned towards the inside of the cylinder and a shaft 17 towards the outside. Usually, the head 16 has a stitch formation plane 18 and, above this, at least one stitch formation mouth 19 for the formation of terry cloth loops or curls. On the upper side, the shaft 17 has a control bottom part 20 and, at the rear, a tail end with a step 21 that is preferably inclined from the top downwards starting from the rear towards the front of the sinker.

The bottom part 20 is intended to interact with the inlet and outlet cams 22, 23 provided for moving each sinker longitudinally forwards and backwards. The tail end step 21 of the sinker interacts with a return cam 24. The sinker is capable of oscillating or rocking in a vertical plane between a resting or inactive position and an operating position.

Figure 4:
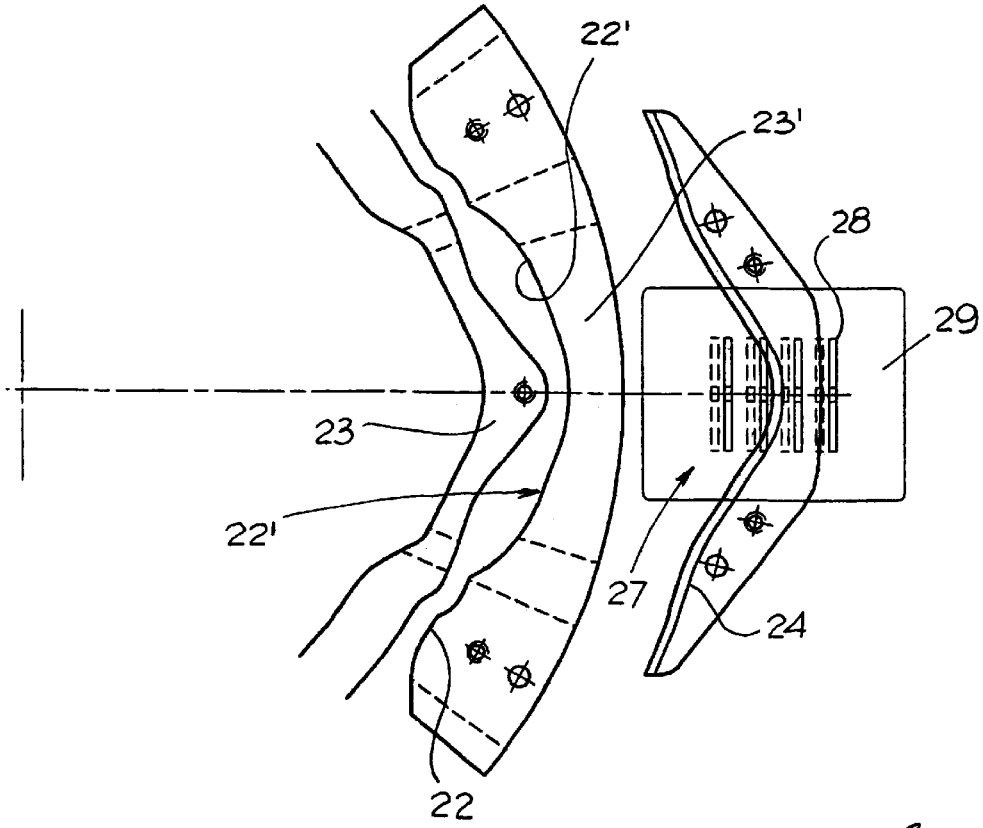
FIG. 4 is a top view of the return and cancellation cams of the sinkers.
Figure 5:
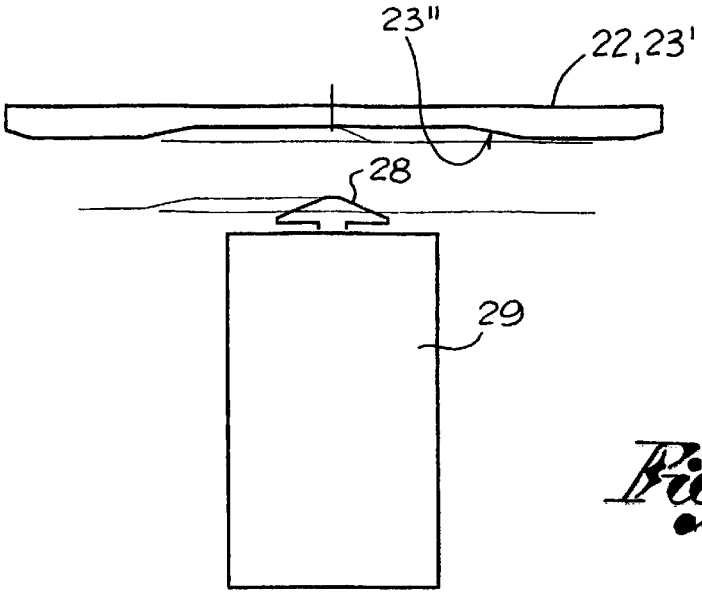
FIG. 5 is a view of the profile of a cancellation cam and of a lever of a selection unit.

When the sinker is in the nonselected position (FIG. 3), its tail end step 21 is in a lowered position and is not intercepted by the return cam 24. This position is defined by a cancellation cam 23' with an appropriate profile 23" acting from the top downwards, on the upper side of the sinker proper. The cancellation cam 23' is provided on the lower face of at least one or both of the inlet 22 and outlet 23 cams (FIGS. 4 and 5). The active or operating position of the sinker is defined by the selector 15, which is also capable of oscillating around a bearing fulcrum 25 between an inactive (lowered) position and an active (raised) position. The selector 15 has an upper plane which rests against a part of the lower side of the sinker 14 and a series of selection teeth 26 on its lower side, with each of which teeth 26 a pushing device 27, arranged at right angles to the plane in which the sinkers and the selectors lie, can be selectively operated. In the example illustrated, the pushing device is represented by the pushing levers 28 of a usual selection unit 29 and they move the selector 15, raising it, from the inactive position to the active position.

Figure 2:
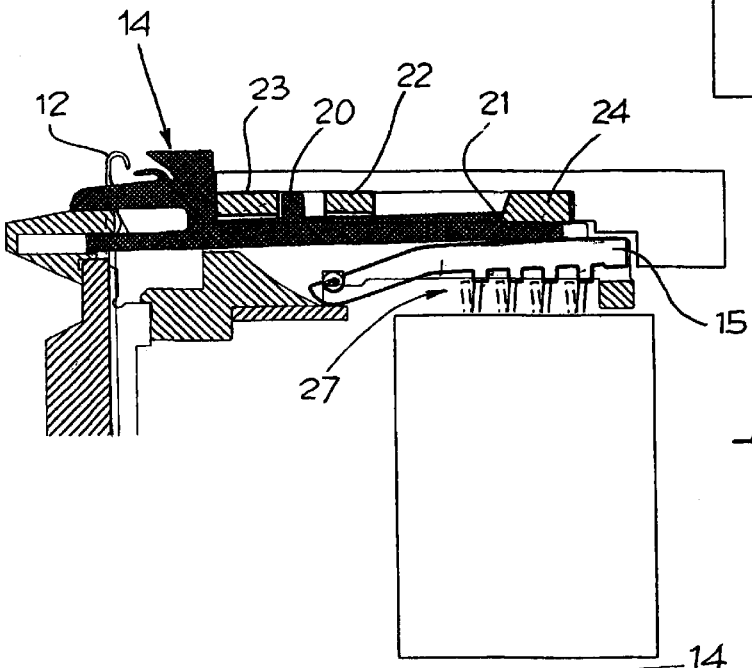
FIG. 2 is a radial sectional view of parts of the cylinder and of the ring, sinker carriers of a circular knitting machine, with a sinker in a selected or active or operating position.
Figure 1:
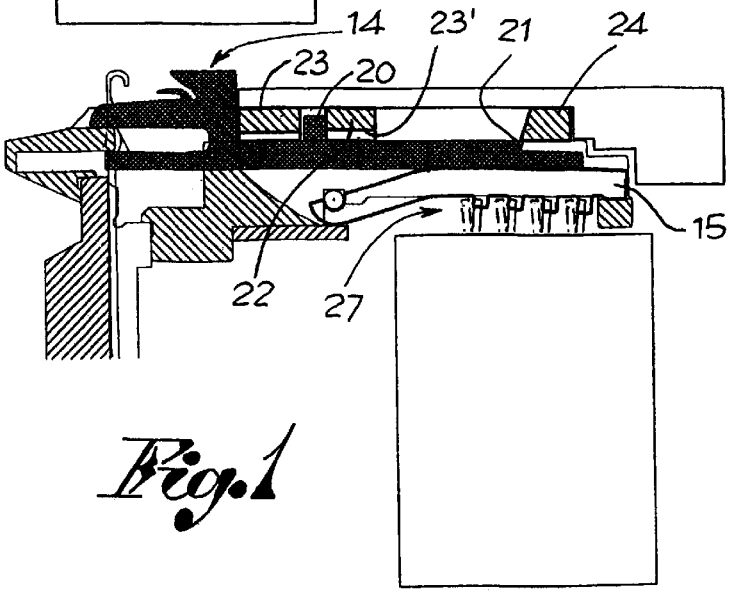
FIG. 1 is a radial sectional view of parts of the cylinder and of the ring, sinker carriers of a circular knitting machine, with a sinker in a canceled or resting position.

When the selection teeth 26 do not interact with the pushing device 27, the selector 15, and then the sinker 14, remain lowered in the canceled, resting position (FIG. 1). On the other hand, if a selection tooth 26 intercepts a pushing lever 28, the selector raises the sinker (FIG. 2), which can then be controlled to operate thanks to the return cam 24 and due to the movement cams 22, 23, which guide the bottom part.

After each selection and before a subsequent selection, the sinker is canceled by means of the cancellation cam 23', or is brought back and maintained in the lowered position (FIG. 3). The bottom part of the resting or nonselected sinker is not intercepted by the profile of the inlet cam, which has a notch 22' corresponding to the selection zone of the sinker.

The selection unit can be managed electronically by the programmer of the circular machine by which the sinkers can be freely selected one by one depending on the design to be created within the framework of the terry cloth knitwear to be manufactured.

It should be noted that all the cams and the pushing device elements are configured symmetrically for controlling the selector and thus the sinker in both of the directions of rotation of the machine, and thus also for the manufacture of designs in a heel or part of a manufactured article knitted by means of reciprocating motion and with a single selection unit.

While specific embodiments of the invention have been shown and described in detail to illustrate the application of the principles of the invention, it will be understood that the invention may be embodied otherwise without departing from such principles.

What is claimed is:

1. A device for selecting knitting sinkers for the manufacture of designed terry cloth knitwear with one of a circular knitting machine and a stocking knitting machines, each sinker having a head with a stitch formation plane and at least one mouth for the formation of oblong terry cloth loops or curls, and a shaft with a control bottom part and a tail end, the device comprising:

inlet and outlet cams;

a return cam causing longitudinal movements of the sinker, each sinker being disposed for oscillations in a vertical plane between a canceled, resting position, in which its tail end is not intercepted by said return cam, and an operating position, in which the tail end interacts with said return cam for the longitudinal movements of the sinker and the bottom part with said inlet and outlet cams;

a selector device for moving the sinker from the canceled, resting position to the operating position, the selector device acting on a selector associated with the shaft of the sinker, said selector device being in a plane which is perpendicular to the plane in which the sinkers lie.

2. A device in accordance with claim 1, wherein the shaft of the sinker has a tail end step interacting with said return cam only when the sinker is in the operating position, and said selector is arranged in a plane of the respective sinker, under the respective sinker and capable of oscillating in a vertical plane on a bearing fulcrum between an inactive position and an active position for an oscillatory movement of the sinker from the canceled, resting position to the operating position, said selector device has a greater bearing plane on a part of the lower side of the shaft of the sinker and a plurality of selection teeth interacting with the selection means for a movement of the selector from the active position to the inactive position.

3. A device in accordance with claim 2, further comprising a cancellation cam provided for an oscillatory movement from the top to the bottom in the canceled, resting position of each sinker before each new selection, said cam being able to be integral or integrated with at least one of the said inlet and outlet cams.

4. A device in accordance with claim 3, wherein said inlet and outlet cams, said return cam, said cancellation cam and said selection device have symmetrical shape attributes for controlling the selection in each of two opposite directions of rotation with a single device.

* * * * *